US009169666B2

(12) United States Patent
Hodgin

(10) Patent No.: US 9,169,666 B2
(45) Date of Patent: Oct. 27, 2015

(54) DOOR LATCH OPERATOR APPARATUS

(75) Inventor: Chris Hodgin, Louisville, TN (US)

(73) Assignee: Yale Security Inc., Monroe, NC (US)

( * ) Notice: Subject to any disclaimer, the term of this patent is extended or adjusted under 35 U.S.C. 154(b) by 596 days.

(21) Appl. No.: 13/344,171

(22) Filed: Jan. 5, 2012

(65) Prior Publication Data

US 2013/0175811 A1 Jul. 11, 2013

(51) Int. Cl.
*B05C 1/12* (2006.01)
*E05B 3/08* (2006.01)

(52) U.S. Cl.
CPC ..... *E05B 3/08* (2013.01); *Y10T 29/49817* (2015.01); *Y10T 29/49826* (2015.01); *Y10T 292/097* (2015.04); *Y10T 292/1014* (2015.04)

(58) Field of Classification Search
USPC ..... 292/164, 359, 358
See application file for complete search history.

(56) References Cited

U.S. PATENT DOCUMENTS

| | | | | |
|---|---|---|---|---|
| 1,484,406 | A * | 2/1924 | Ottinger | 292/336.5 |
| 2,271,266 | A | 1/1942 | Kost | |
| 4,189,248 | A | 2/1980 | Sully | |
| 4,728,133 | A * | 3/1988 | Valley | 292/336.3 |
| 4,784,418 | A | 11/1988 | Pearson et al. | |
| 5,228,798 | A * | 7/1993 | Tzanovici | 403/362 |
| 6,669,249 | B1 * | 12/2003 | Huang et al. | 292/337 |
| 6,921,116 | B2 * | 7/2005 | Humes | 292/169 |
| 7,082,794 | B2 * | 8/2006 | Shen et al. | 70/224 |
| 7,226,233 | B2 | 6/2007 | SuBenbach et al. | |
| 7,281,738 | B2 | 10/2007 | Shen et al. | |
| 7,497,486 | B1 | 3/2009 | Davis et al. | |
| 2010/0263418 | A1 | 10/2010 | Moon | |

FOREIGN PATENT DOCUMENTS

| | | | |
|---|---|---|---|
| CH | 670861 | A5 | 7/1989 |
| DE | 261579 | C | 6/1913 |
| DE | 673668 | C | 3/1939 |
| DE | 872922 | C | 4/1953 |
| DE | 1031176 | B | 5/1958 |
| DE | 202009013586 | U1 | 1/2010 |
| GB | 1914000257 | | 0/1914 |
| WO | 2011042231 | A1 | 4/2011 |

OTHER PUBLICATIONS

European Patent Office, International Application No. PCT/US2013/020207 International Search Report and Written Opinion dated Jul. 4, 2013. pp. 1-12.

The International Bueau of WIPO, International Application No. PCT/US2013/020207 International Preliminary Report on Patentability dated Jul. 17, 2014, 9 pages.

* cited by examiner

*Primary Examiner* — Mark Williams
(74) *Attorney, Agent, or Firm* — Michael G. Johnston; Moore and Van Allen PLLC

(57) ABSTRACT

A device for securing a spindle to a hub in a mortise lock for a door. The device includes a hub defining a central opening about an axis of rotation and a spindle with a first end adapted to be received in the opening in the hub to apply rotational force to the hub. A securing element is moveable between a first position in which the securing element engages the spindle and the spindle is secured to the hub, and a second position in which the securing element is disengaged from the spindle and the spindle may be freely removed from the opening in the first hub. The securing element may be adapted for reciprocal linear movement in the housing, and may engage the first spindle by part of the securing element being received in a peripheral groove in the spindle.

10 Claims, 9 Drawing Sheets

DOOR LATCH OPERATOR APPARATUS

BACKGROUND

Embodiments described herein relate generally to door latches, and more particularly to latch operator connection apparatus for a mortise lock that is inserted in a mortise in the edge of a door.

A mortise lock includes a housing with, among other things, a hub rotatably disposed in the housing and operatively connected through linkages to a latch bolt. Rotating the hub in one direction effects linear retraction of the latch bolt. A latch operator such as a knob or a lever handle is provided for rotating the hub. A spindle, which is usually square in cross section, connects the latch operator and the hub. The hub defines a receptacle, also usually square, for nonrotatably receiving the spindle. When either handle is rotated or depressed, the hub rotates, which results in retraction of the latch bolt, allowing opening of the door. Two separate hubs may be provided in a mortise lock, where inside and outside latch operators independently operate each hub. The two hubs are coaxial, but are functionally separate from one another.

Some configurations of a spindle may include a unitary spindle that extends through the case and is secured at each end to the inside and outside latch operators, respectively. In this arrangement, the inside handle is permanently engaged with the hub and the outside handle. A second configuration consists of separate spindles for each of the latch operators. The separate spindles may be joined at their inner ends by an "all-thread" threaded rod such that the spindles are connected but may rotate relative to one another. This second configuration can be used with a single hub or two independent hubs. In the latter arrangement, the latch operators separately actuate the hub or hubs. Assembly and disassembly may require significant time and effort.

SUMMARY

In accordance with one embodiment, a spindle connecting device for a mortise lock is provided. The mortise lock includes a housing and a latch bolt disposed at least in part in the housing. The latch bolt is adapted for reciprocal linear movement and is operable with a latch operator. The device includes a first hub defining a central opening about an axis of rotation, with the first hub adapted to operatively communicate with the latch bolt to transmit force to retract the latch bolt. A first spindle has a longitudinal axis, a first end, and a second end. The first end is adapted to be received in the opening in the first hub and to apply rotational force to the first hub. The second end of the first spindle is adapted to operatively communicate with the latch operator. A securing element is provided that is moveable between a first position in which the securing element engages the first spindle and the first spindle is secured to the first hub, and a second position in which the securing element is disengaged from the first spindle and the first spindle may be freely removed from the opening in the first hub. In some such embodiments, the first spindle defines a first peripheral groove proximate to the first end. The securing element may be adapted for reciprocal linear movement in the housing, movable in a direction substantially perpendicular to the longitudinal axis of the first spindle. The securing element may also engage the first spindle by part of the securing element being received in the first peripheral groove, and the securing element may be disengaged from the first spindle by the securing element being completely outside the first peripheral groove.

In some embodiments, the securing element includes a first end, a second end, and two spaced, parallel sides extending from the first end, each side including a lip portion spaced from the first end, and the part of the securing element received in the groove in the first position is part of the lip portion. In such embodiments, the two sides of the securing element define opposing slots in the sides aligned with the direction of linear movement of the securing element, and further include a retaining element slidably mounted to the securing element between the two sides and in the slots of the securing element and adapted to be mounted to the housing, and means for biasing the first end of the securing element away from the retaining element.

In accordance with another embodiment, another spindle connecting device is provided. The device includes a first hub defining a central opening about an axis of rotation. The first hub is adapted to operatively communicate with the latch bolt to transmit force to retract the latch bolt. A first spindle has a longitudinal axis, a first end, and a second end, and the first end adapted to be received in the opening in the first hub and to apply rotational force to the first hub. The first spindle defines a first peripheral groove proximate to the first end, and the second end of the first spindle is adapted to be mounted to the latch operator. Means for securing the first spindle to the first hub at the first peripheral groove are provided. In some embodiments, a second spindle is provided having a longitudinal axis, a first end, and a second end, and the second spindle first end is adapted to be received in the opening in the second hub and to apply rotational force to the second hub. The second spindle defines a second peripheral groove proximate to the first end, and the second end of the second spindle is adapted to operatively communicate with the latch operator. The means for securing the first spindle to the first hub also secures the second spindle to the second hub at the second peripheral groove.

In accordance with another embodiment, a mortise lock operable with a latch operator is provided. The mortise lock includes a housing, a latch bolt disposed at least in part in the housing for reciprocal linear movement, a first hub, a first spindle, and a securing element. The first hub defines a central opening about an axis of rotation and is in operative communication with the latch bolt to transmit force to retract the latch bolt. The first spindle has a longitudinal axis, a first end, and a second end. The first end is received in the opening in the first hub to apply rotational force to the first hub. The second end of the first spindle is in operative communication with the latch operator. The securing element is moveable between a first position in which the securing element engages the first spindle and the first spindle is secured to the first hub, and a second position in which the securing element is disengaged from the first spindle and the first spindle may be freely removed from the opening in the first hub.

In some embodiments, the securing element includes a first end, a second end, and two spaced, parallel sides extending from the first end, each side including a lip portion spaced from the first end, and the part of the securing element received in the groove in the first position is part of the lip portion. In such embodiments, the two sides of the securing element define opposing slots in the sides aligned with the direction of linear movement of the securing element, and further include a retaining element slidably mounted to the securing element between the two sides and in the slots of the securing element and mounted to the housing, and means for biasing the first end of the securing element away from the retaining element.

In accordance with another embodiment, a method of assembling a spindle in a mortise lock operable with a latch operator is provided. The mortise lock includes a housing, a latch bolt disposed at least in part in the housing for reciprocal linear movement, a hub, a spindle, and a securing element. The hub defines a central opening about an axis of rotation, the hub in operative communication with the latch bolt to transmit force to retract the latch bolt. The spindle has a longitudinal axis, a first end, and a second end. The first end is received in the opening in the hub to apply rotational force to the hub. The spindle defines a peripheral groove proximate to the first end, and the second end of the spindle is adapted to be mounted to the latch operator. The securing element is disposed in the housing for reciprocal linear movement, with the securing element movable in a direction substantially perpendicular to the longitudinal axis of the spindle. The method includes inserting the first end of the spindle into the opening in the hub, and contacting the securing element with the first end of the spindle. The first end of the spindle is advanced further into the opening in the hub to move the securing element out of the path of the first end of the spindle. Then the first end of the spindle is further advanced into the opening in the hub until the groove in the spindle reaches the securing element and the securing element advances into the groove. In some embodiments, the method further includes applying force to the securing element to move the securing element out of the groove, and withdrawing the first end of the spindle from the opening in the hub.

BRIEF DESCRIPTION OF THE DRAWINGS

For a more complete understanding, reference should now be had to the embodiments shown in the accompanying drawings and described below. In the drawings.

DETAILED DESCRIPTION

The embodiments of a door latch operator connection device described herein may be for use with a conventional mortise lock for a conventional door, including, for example, a door hinged on a vertical edge or a sliding door. Moreover, it is understood that the overall construction of the mortise lock components and the door is not critical. Accordingly, although exemplary embodiments will be described in detail herein with respect to a mortise lock function, detailed explanations of the functioning of the mortise lock components are deemed unnecessary for understanding by one of ordinary skill in the art.

Certain terminology is used herein for convenience only and is not to be taken as a limitation. For example, words such as "front," "back," "top," "bottom," "rear," "upper," "lower," "left," "right," "horizontal," "vertical," "upward," and "downward" merely describe the configuration shown in the figures. The components may be oriented in any direction and the terminology, therefore, should be understood as encompassing such variations unless specified otherwise.

Figure 1:
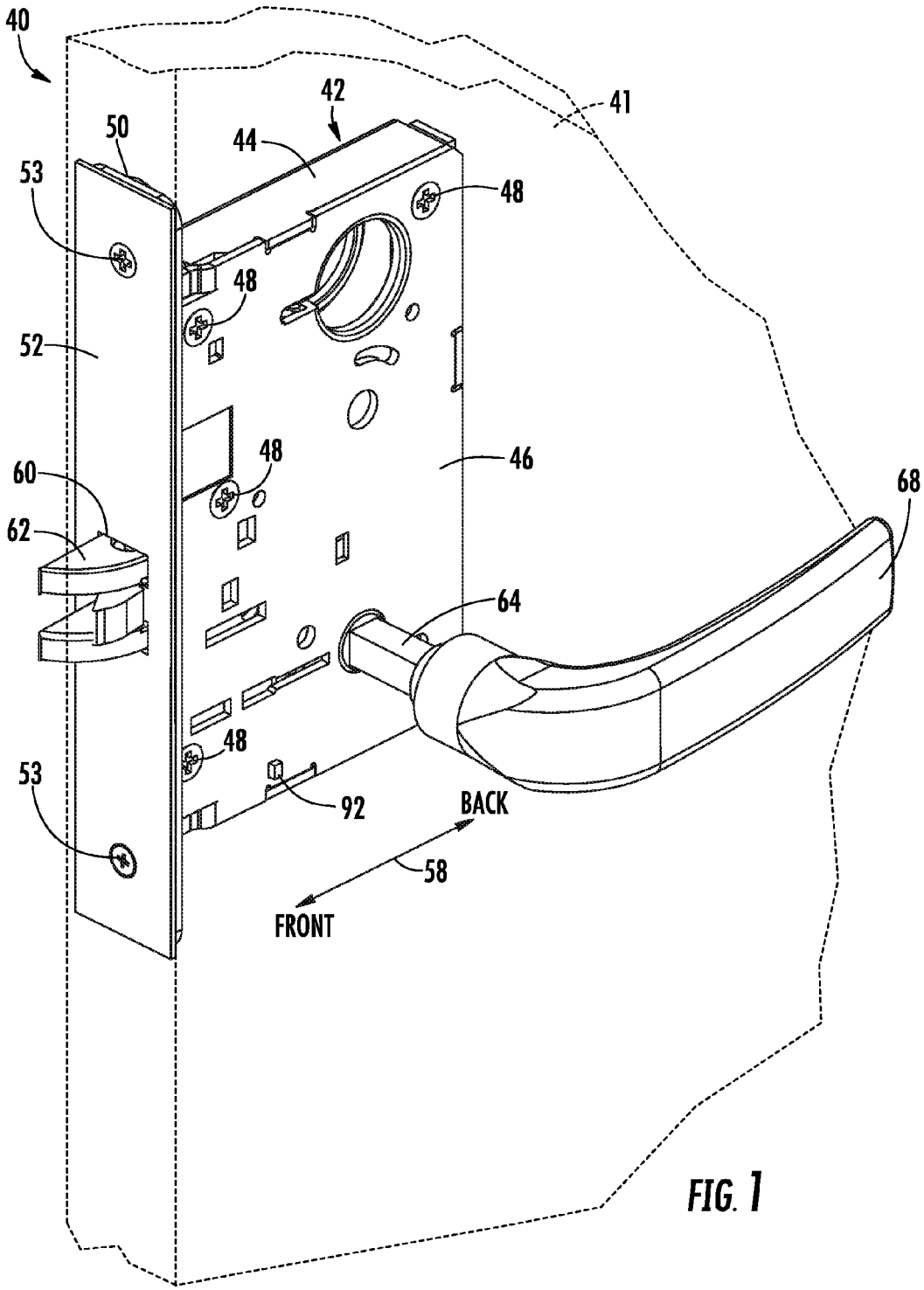
FIG. 1 is a left perspective view of an embodiment of a mortise lock, cover plate, spindles, and latch operators.
Figure 2:
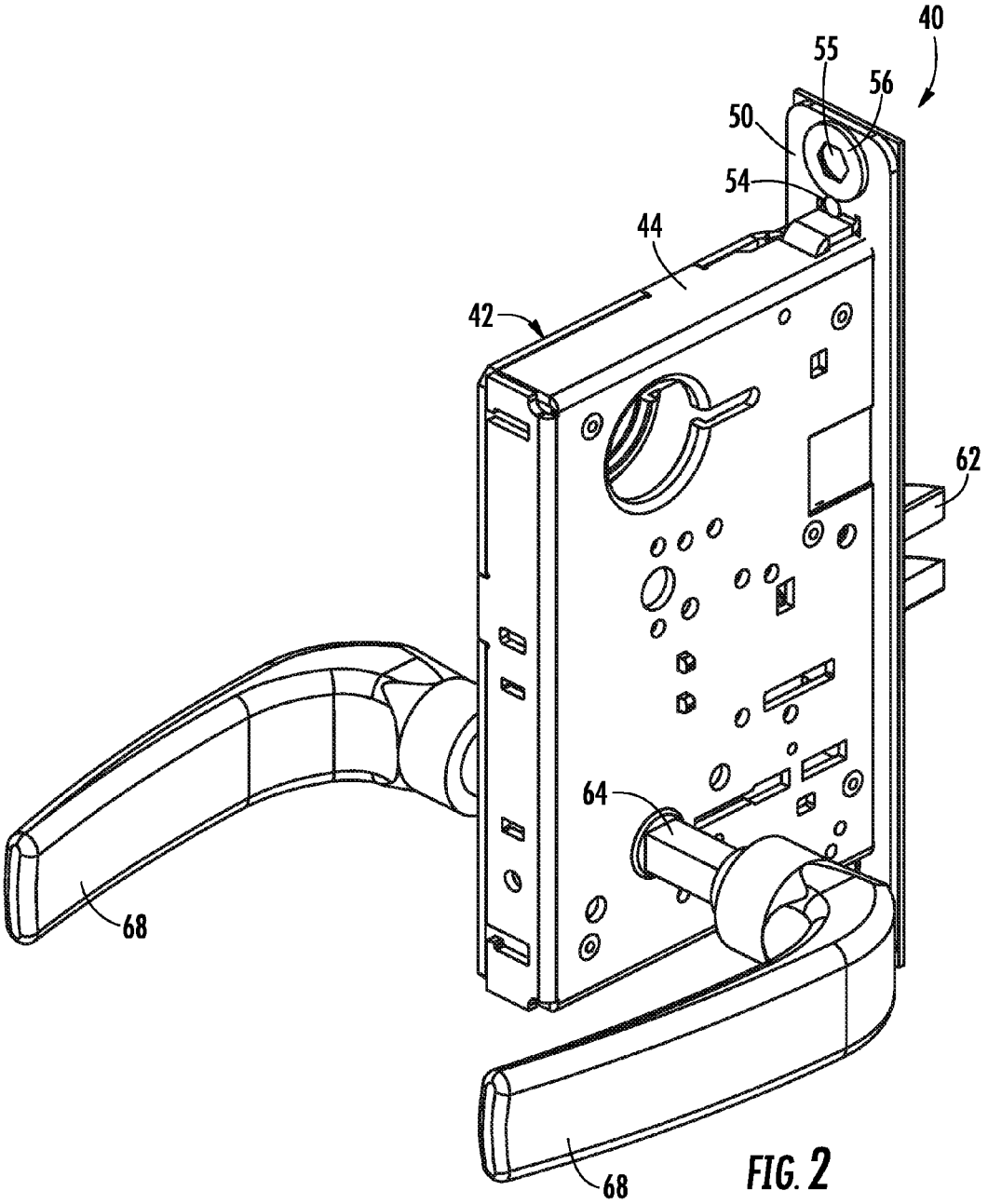
FIG. 2 is a right perspective view of an embodiment of a mortise lock, cover plate, spindles, and latch operators.

Referring now to the drawings, wherein like reference numerals designate corresponding or similar elements throughout the several views, an embodiment of a mortise lock for use on a conventional hinged door is shown in FIGS. 1 and 2 and is generally designated at 40. The mortise lock 40 will be inserted into a rectangular opening or mortise in the edge of a door 41.

The mortise lock 40 includes a housing 42, which includes a case 44, a cover 46 mounted to the case 44 with fasteners, shown as screws 48, and a base front 50 also mounted to the case 44. The base front 50 is conventionally mounted to a recessed area in the door edge. An armor front 52 is mounted to the base front 50 with screws 53 that extend through holes 54 in the base front 50, and covers the front side of the base front 50. The mortise lock 40 is mounted to the door with screws (not shown) that extend through holes 55 at the top and bottom of the base front 50. Reinforcing 56 is provided on the back side of the base front 50 around the holes 55. Direction arrow 58 shows the general designations of front and back of the mortise lock 40, with front being at the armor front 52.

In the embodiment shown, the armor front 52 has an aperture 60 for a latch 62. Spindles 64 are operatively connected to the latch 62, and latch operators, in this case levers 68, are connected to the spindles 64.

Figure 3:
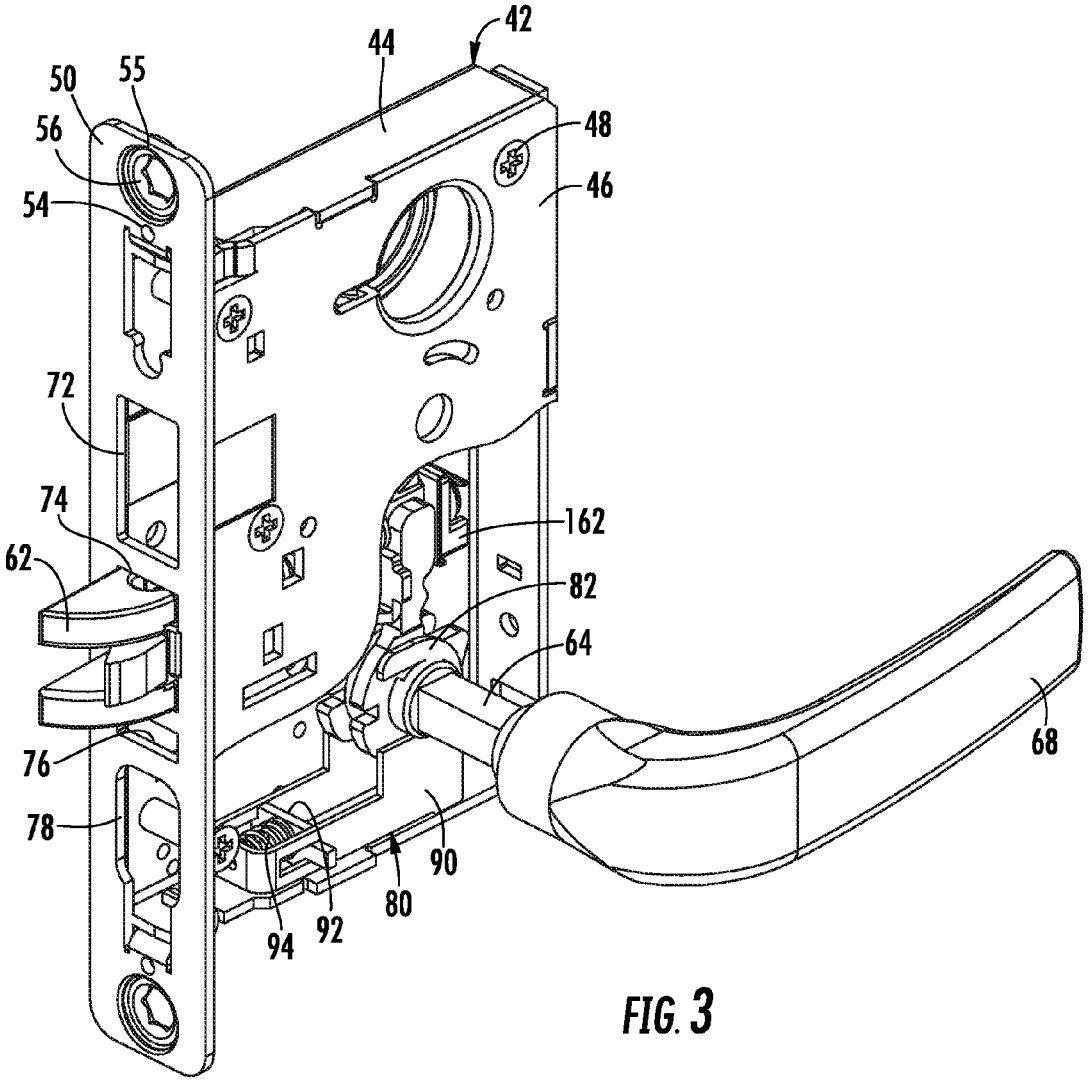
FIG. 3 is a partially exposed left perspective view of the mortise lock of FIG. 1 showing an embodiment of a latch operator mounting device.

In FIG. 3, the armor front 52 is removed to expose the front of the base front 50. The base front 50 defines apertures that may allow features to pass through the base front 50. One aperture 72 may be used for a deadbolt, not included in this embodiment. Another aperture 74 allows the latch to pass through. A third aperture 76 is for a guard bolt for effectively deadbolt the latch bolt when pushed inward, also not included in this embodiment. A fourth aperture 78 is for a toggle button for keeping the latch 62 in a constant locked or unlocked state, not shown. If a deadbolt and a guard bolt were provided, there would be corresponding apertures in the armor front 52.

The housing cover 46 is truncated in FIG. 3 to expose a portion of an embodiment of a latch operator mounting device 80 mounted to the case 44 and cover 46. The embodiment of a latch operator mounting device 80 is shown in FIGS. 4-9, and includes spindles 64, hubs 82, 84, center ring 86, spindle catch 90, retainer 92, and spring 94.

The spindles 64 may be elongated and substantially square in cross section. The spindles 64, as shown in this embodiment, may have the same shape and be duplicate parts. The inner end 100 of each spindle 64 may be tapered or have beveled corners, and proximate to the inner end 100 is a peripheral groove 104. At the peripheral groove 104 the spindles 64 may have a circular cross section. An opening 108 is provided on one face of each spindle 64 to receive a roll pin 110 that is disposed in an aperture 112 through the collar 114 of the levers 68. An opening in each lever 68 at the collar 114 receives an outer end 122 of the adjacent spindle 64, and has longitudinal notches 126 to prevent the spindle 64 from rotating relative to the lever 68.

Figure 6:
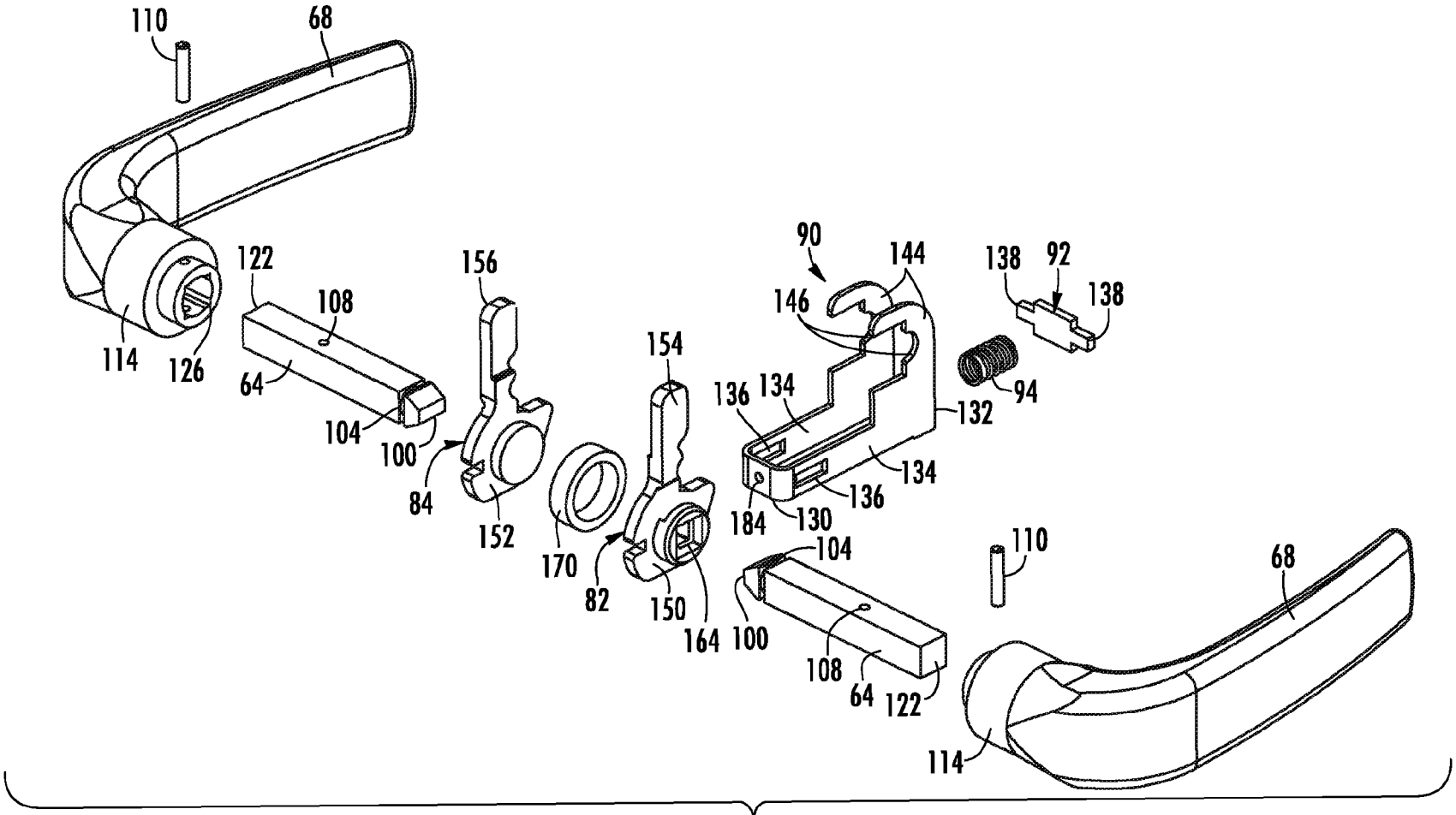
FIG. 6 is an exploded perspective view of the latch operator mounting device of FIG. 3.
Figure 7:
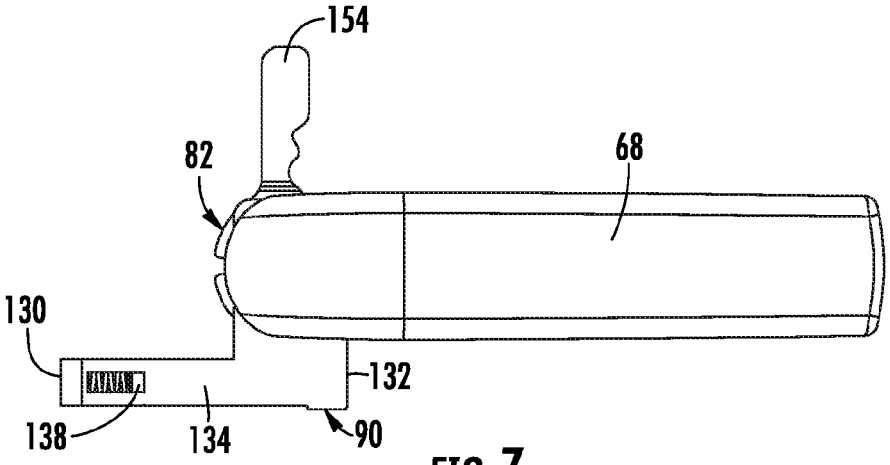
FIG. 7 is a left side view of the latch operator mounting device of FIG. 3.
Figure 8:
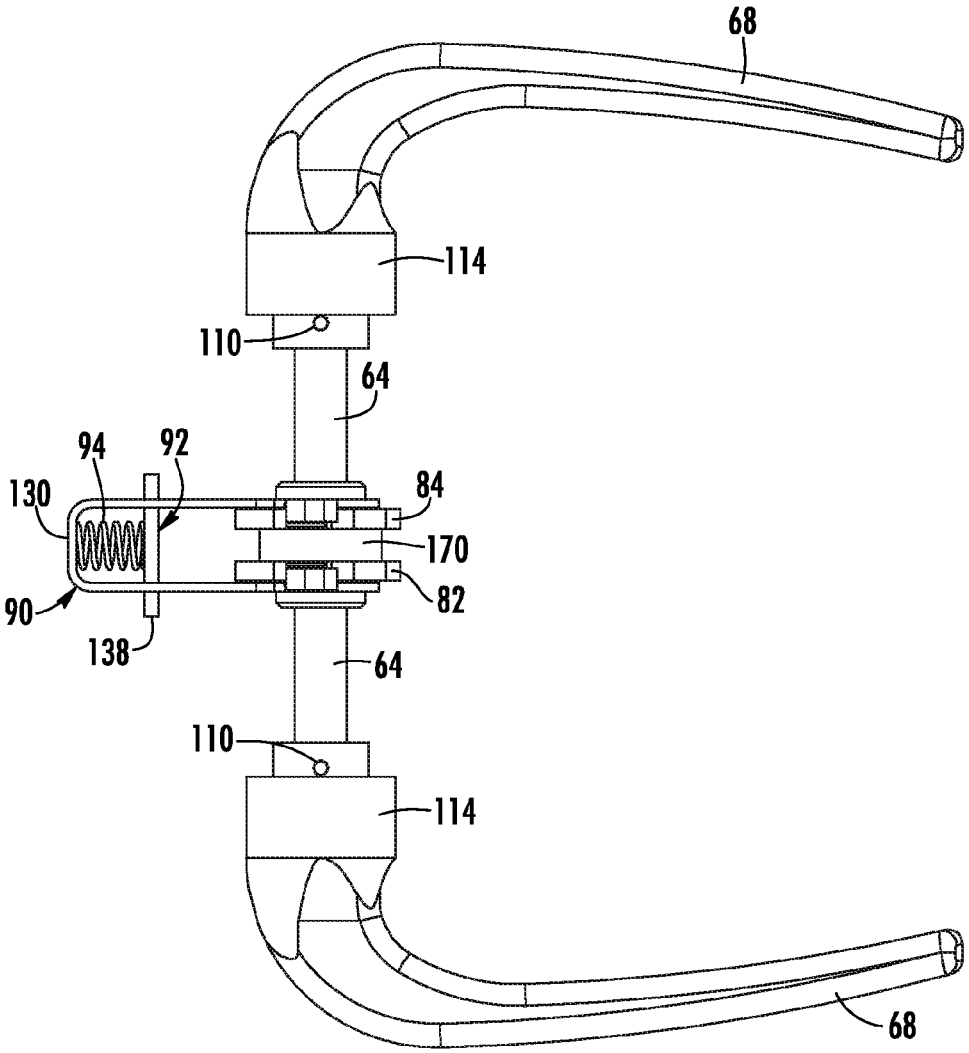
FIG. 8 a top view of the latch operator mounting device of FIG. 3.
Figure 9:
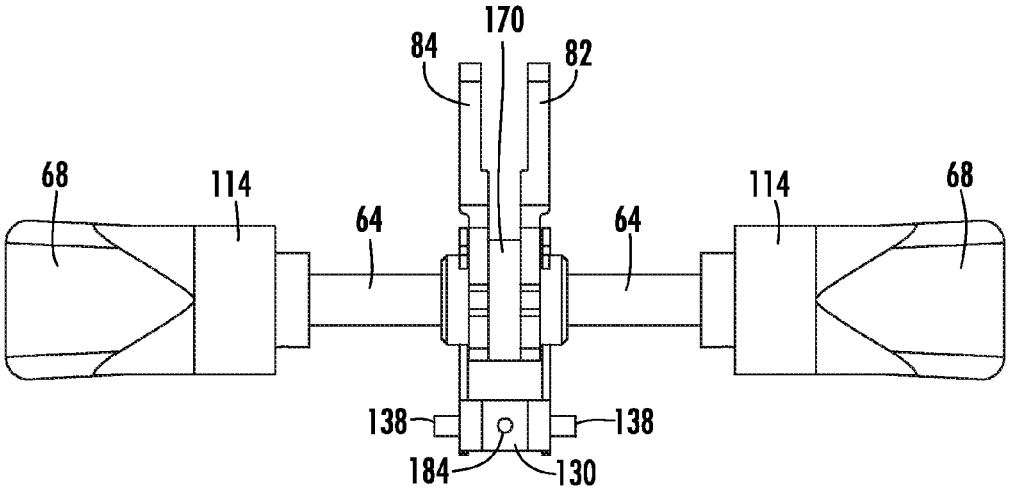
FIG. 9 is a rear view of the latch operator mounting device of FIG. 3.

As shown in FIG. 6, the spindle catch 90, which may be a means for securing a spindle 64 to a hub 82, 84, may be formed from a stamped sheet or plate into a substantially U-shaped member, with a closed end 130 at the front and an open end at the back, and sides 134 extending from the closed end 130. The lower portion of the spindle catch 90 may be elongated and includes a slot 136 on each side that receives prongs 138 that are at each end of the retainer 92, which between the prongs 138 may be a substantially planar member. The open ends of the spindle catch 90 allow outward deflection of the sides 134, which in turn permits mounting of the retainer 92 in the spindle catch 90. The spring 94, which in this embodiment is a coil spring, is placed in between the retainer 92 and the closed end 130 of the spindle catch 90 to bias the closed end 130 of the spindle catch 90 and the retainer 92 apart. The latch operator mounting device 80 is mounted in the mortise lock housing by insertion of the prongs 138 into an opening 140 through the cover 46 and an opening 142 through the side of the case 44 (FIGS. 1 and 2). Consequently, the retainer 92 is in a fixed position in the housing 42, and the spindle catch 90 is slidably disposed in the housing 42, with movement permitted, and constrained, by the slots 136 in the sides of the spindle catch 90.

Spaced from the front end 130 of the spindle catch 90, and, in the embodiment shown, at the back end 132 of the spindle catch 90, the sides 134 extend upward and form lips 144. The lips 144 may be substantially U-shaped, with the open end facing the front of the mortise lock 40. At the closed end of the "U" is an engagement portion 146. The engagement portion 146 has an arc-shaped recess, and is received in the peripheral groove 104 in the adjacent spindle 64. The shape of the recess permits the spindle 90 to rotate, while the engagement portion 146 is within the groove 104.

Figure 4:
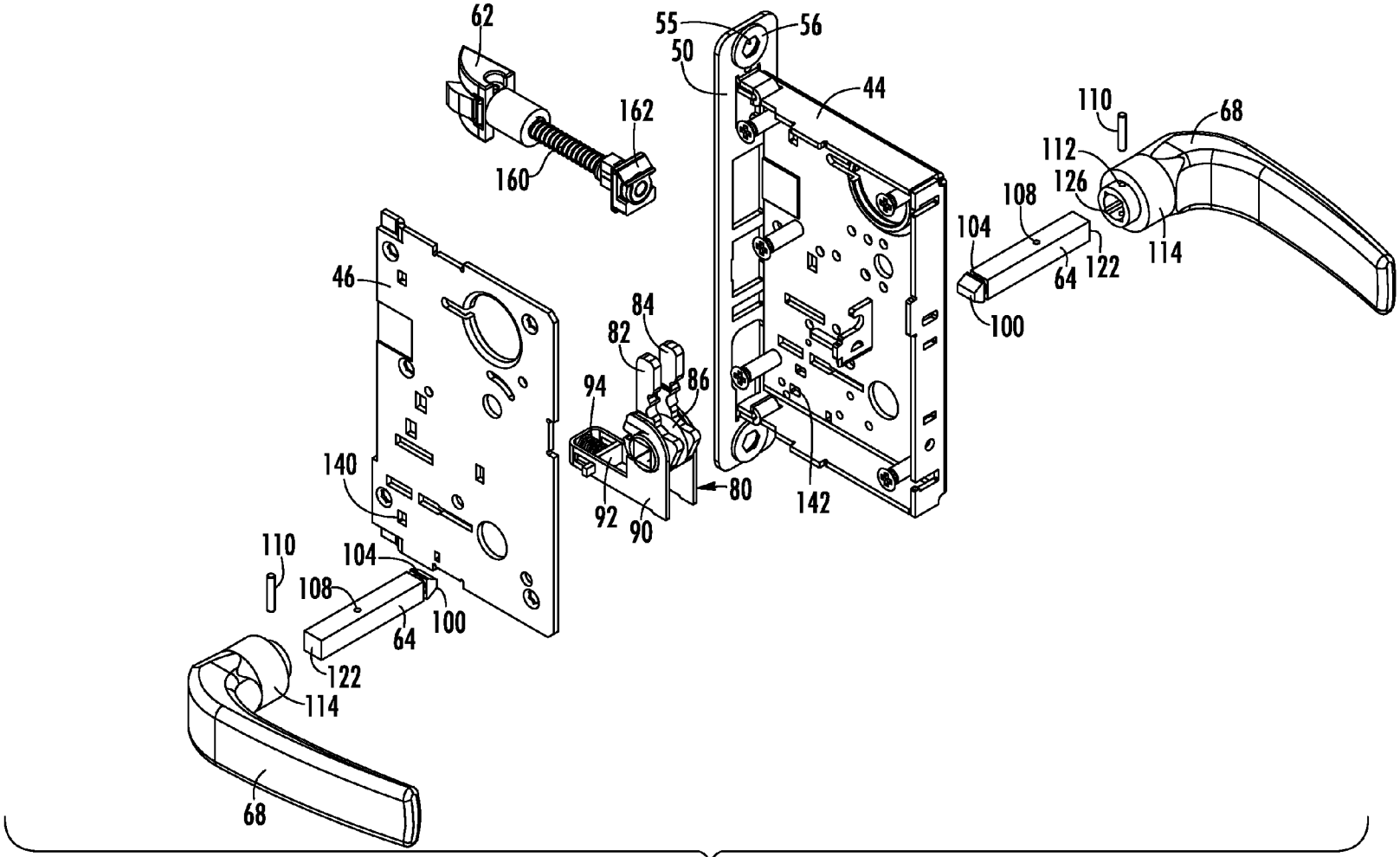
FIG. 4 is an exploded perspective view the mortise lock of FIG. 1 showing the embodiment of a latch operator mounting device of FIG. 3.
Figure 5:
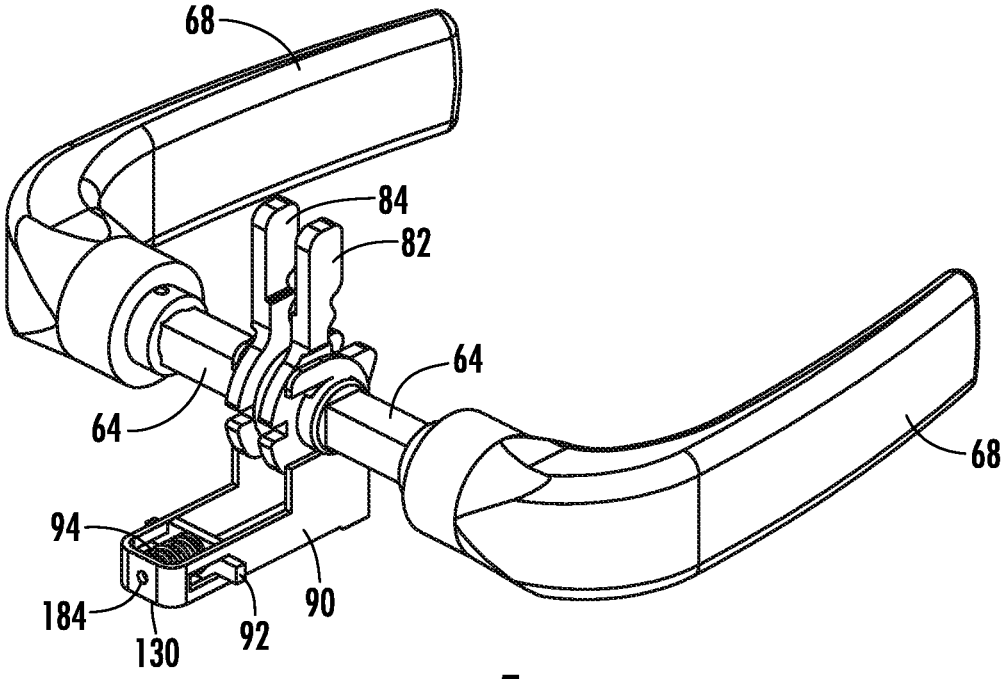
FIG. 5 a perspective view of the latch operator mounting device of FIG. 3.

The hubs 82, 84 include a central portion 150, 152 and an arm 154, 156 extending from the central portion 150, 152. The hubs 82, 84 are rotatably disposed in the mortise lock case 44, and are operatively connected to a latch bolt 160 (FIG. 4). Rotating the hub 82, 84 in one direction rotates the respective arm 154, 156 to apply force to the latch tail 162 and effects linear retraction of the latch bolt 160. The central portion 150, 152 of each hub 82, 84 defines a square receptacle 164 to receive the inner end 100 of the spindle 64, whereby each hub 82, 84 rotates with its respective spindle 64 when that spindle 64 is rotated by depressing the associated lever 68. The receptacle 164 may not pass entirely through the central portion 150, 152, such that the spindle 64 abuts the back of the receptacle 164 and is prevented from passing through the central portion 150, 152. The hubs 82, 84 are coaxial but functionally separate, being rotatably mounted to each other, whereby each rotates independently from the other one. A center ring 170 may be interposed between the central portions 150, 152 to support the hubs 82, 84, or alternatively such a structure could be integral to one of the hubs 82, 84.

The lips 144 of the spindle catch 90 axially position the hubs 82, 84, as the hubs 82, 84 are mounted substantially between the lips 144. A collar 166 on each hub extends axially outside the lips 144, and a slot 168 is provided in each collar 166 that receives the engagement portion 146 of the lips 144 to allow the engagement portion 146 to reach the groove 104 in the spindle 90. When the engagement portion 146 is in the groove 104, the engagement portion 146 impedes withdrawal of the spindle 90 from the receptacle 164.

Figure 10:
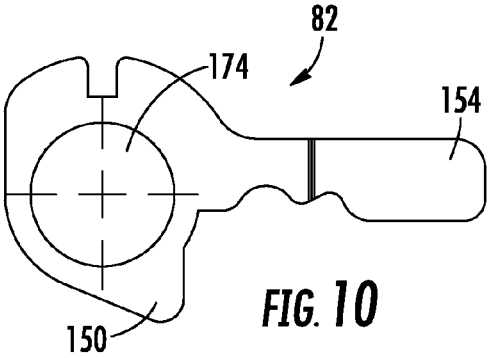
FIG. 10 is a side elevation view of an embodiment of one of the two hubs of the latch operator mounting device of FIG. 2.
Figure 11:
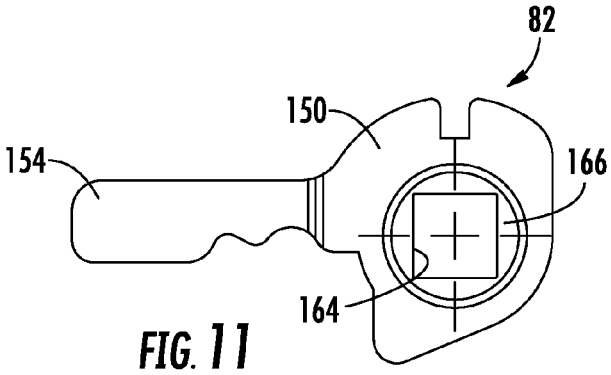
FIG. 11 is an opposite side elevation view of the hub of FIG. 10.
Figure 12:
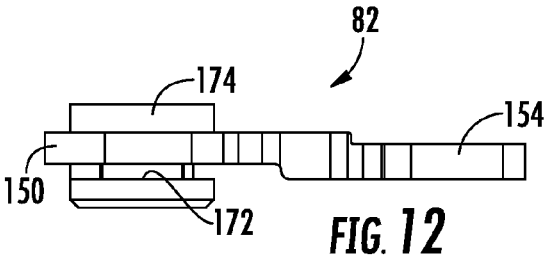
FIG. 12 is an end view of the hub of FIG. 10.

FIGS. 10-12 show a hub 82. The other hub 84 may be, as shown, a mirror image of this hub 82, or may have a different structure. As previously noted, the hubs 82, 84 each have a central portion 150, 152, an arm 154, 156, and a collar 166. A slot 172 is also provided in each collar 166 to receive an engagement portion 146 of a lip 144 of a spindle catch 90. Each hub 82, 84 has an inner surface with a cylindrical protrusion 174 that is received in the center ring 170 that maintains the ring 170 and the hubs 82, 84 in registration.

The components of the mortise lock housing 42, the spindle catch 90, the spindles 64, the hubs 82, 84, and the levers 68 may generally be metal, such as carbon steel or stainless steel, or other material as selected by one of ordinary skill in the art. The retainer 92 may be, for example, plastic, such as nylon in one embodiment, or other material as selected by one of ordinary skill in the art.

Figure 13:
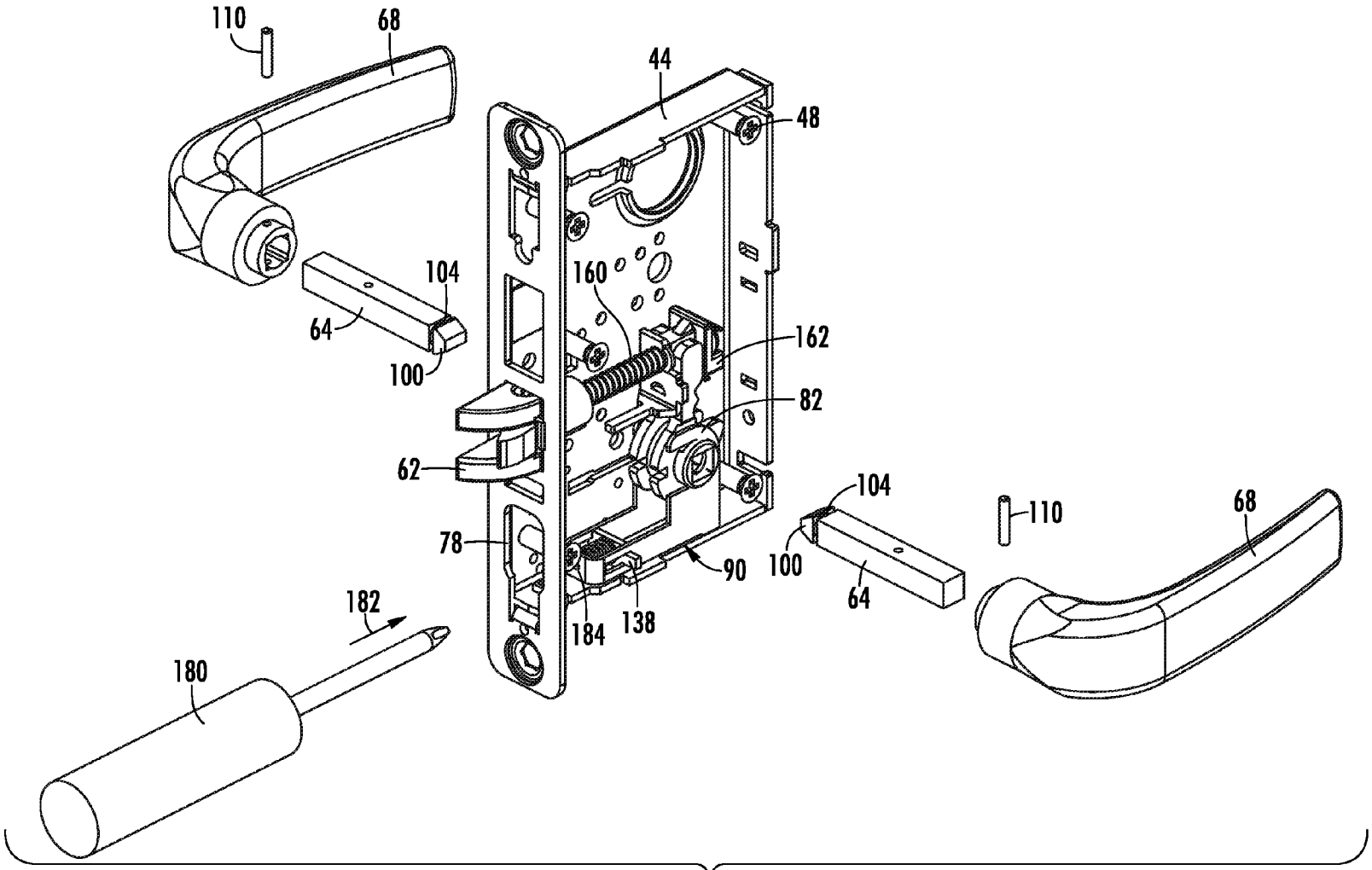
FIG. 13 is a partially exposed, partially exploded, left perspective view of the mortise lock, spindles, and latch operators of FIG. 1 showing the operation of the latch operator mounting device of FIG. 3.

FIG. 13 shows the mortise lock 40 with the cover 46 removed. The arms 154, 156 of the hubs 82, 84 abut the inner surface of the tail 162 of the latch bolt 160, and linearly displace the latch bolt 160 when the respective lever 68 is depressed. Once the lock 40 is installed in the mortise lock pocket of the door 41, the lever assemblies, each including a lever 68 mounted to a spindle 90 with a roll pin 110, are ready to be installed. The spindle inner end 100 is inserted into the receptacle in the hub 82, 84. As the inner end 100 is inserted, it is impeded slightly on one edge by the engagement portion 146 of the lip 144 of the spindle catch 90. The spindle catch 90 is spring loaded, or biased, inward toward the spindle 64. The inner end 100 of the spindle 64 forces the engagement portion 146 to retract from the receptacle 164, and the inner end 100 is inserted further. When the inner end 100 is inserted to a certain point, the peripheral groove 104 reaches the engagement portion 146, which continues to be biased against the side of the spindle 64. At that time, the engagement portion 146 enters the groove 104, locking the spindle 90 in place. The spindle 90 effectively is "snapped into" position.

To remove the spindle 64 from the hub 82, 84, first the armor front 52 (FIG. 1) is removed from the base front 50. At bottom of the lowest aperture 78 in the base front 50, space may be provided for a screwdriver 180 to be inserted 182 through the base front 50 and to apply force to the spindle catch 90 toward the back of the mortise lock 40. A small aperture 184 may be provided in the front surface of the spindle catch 90 to facilitate engagement by the screwdriver 180. The spindle catch 90 is displaced rearward, against the bias of the spring 94, and accordingly the engagement portion 146 is displaced from the peripheral groove 104 in the spindle 64. When this occurs, the lever 68 and spindle 64 may be removed from the hub 82, 84 by pulling away from the door 41, and are thereby disassembled from the mortise lock 40.

Although only a few exemplary embodiments have been shown and described in considerable detail herein, it should be understood by those skilled in the art that we do not intend to be limited to such embodiments since various modifications, omissions and additions may be made to the disclosed embodiments without materially departing from the novel teachings and advantages, particularly in light of the foregoing teachings. Accordingly, we intend to cover all such modifications, omission, additions and equivalents as may be included within the spirit and scope as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A mortise lock operable with a latch operator, the mortise lock comprising:

a housing;

a latch bolt disposed at least in part in the housing for reciprocal linear movement;

a first hub defining a central opening about an axis of rotation, the first hub in operative communication with the latch bolt to transmit force to retract the latch bolt;

a first spindle having a longitudinal axis, a first end, a second end, and a first peripheral groove proximate to the first end, the first end of the first spindle received in the opening in the first hub to apply rotational force to the first hub, the second end of the first spindle adapted to be in operative communication with the latch operator;

a linearly moveable securing element having a first end, a second end, and two spaced parallel sides extending from the first end, each side defining opposing slots aligned with the direction of linear movement of the securing element, and each side including a lip portion spaced from the first end, wherein the securing element is moveable between a first position where a portion of the securing element is received in the first peripheral groove of the first spindle and the first spindle is secured to the first hub, and a second position where the securing element is spaced from the first peripheral groove and the securing element is disengaged from the first spindle and the first spindle may be freely removed from the opening in the first hub;

a retaining element slidably mounted to the securing element between the two sides and in the slots of the securing element and mounted to the housing; and means for biasing the first end of the securing element away from the retaining element, wherein the securing element is capable of being moved from the first position to the second position by an implement inserted through an opening in the housing.

2. The lock of claim 1, wherein the means for biasing comprises a coil spring.

3. The lock of claim 2, wherein the coil spring is interposed between the first end of the securing element and the retaining element.

4. The lock of claim 1, wherein the retaining element is substantially planar.

5. The lock of claim 4, wherein the retaining element has a first end and a second end, including a prong on each end that extends through one of the slots in the securing element.

6. The lock of claim 1, wherein the first end of the first spindle has beveled corners, and wherein the first spindle applies force to the lip portion when inserted in the opening of the first hub to move the securing element from the first position to the second position.

7. The lock of claim 1, wherein the first end of the first spindle is tapered, and wherein the first spindle applies force to the lip portion when inserted in the opening of the first hub to move the securing element from the first position to the second position.

8. A mortise lock operable with a latch operator, the mortise lock comprising:

a housing;

a latch bolt disposed at least in part in the housing for reciprocal linear movement;

a first hub defining a central opening about an axis of rotation, the first hub in operative communication with the latch bolt to transmit force to retract the latch bolt;

a first spindle having a longitudinal axis, a first end, a second end, and a first peripheral groove proximate to the first end, the first end of the first spindle received in the opening in the first hub to apply rotational force to the first hub, the second end of the first spindle adapted to be in operative communication with the latch operator;

a securing element having a first end, a second end, and two spaced parallel sides extending from the first end, each side including a lip portion spaced from the first end, wherein the securing element is moveable between a first position where a portion of the securing element is received in the first peripheral groove of the first spindle and the first spindle is secured to the first hub, and a second position where the securing element is spaced from the first peripheral groove and the securing element is disengaged from the first spindle and the first spindle may be freely removed from the opening in the first hub; and a second hub defining a central opening about an axis of rotation, the second hub in operative communication with the latch bolt to transmit force to retract the latch bolt, wherein each of the first hub and the second hub is rotatably mounted to one of the lip portions of the sides of the securing element and to the other hub, and wherein the securing element is capable of being moved from the first position to the second position by an implement inserted through an opening in the housing.

9. The lock of claim 8, further comprising a second spindle having a longitudinal axis, a first end, and a second end, the second spindle first end received in the opening in the second hub to apply rotational force to the second hub, the second spindle defining a second peripheral groove proximate to the first end, the second end of the second spindle in operative communication with the latch operator.

10. The lock of claim 9, wherein in the first position the securing element is received in the second peripheral groove and the second spindle is secured to the second hub, and in the second position the securing element is completely outside the second peripheral groove and the second spindle may be freely removed from the opening in the second hub.

* * * * *